US007006115B2

(12) United States Patent
Janardhanan et al.

(10) Patent No.: US 7,006,115 B2
(45) Date of Patent: Feb. 28, 2006

(54) SUPPORTING VARIABLE LINE LENGTH IN DIGITAL DISPLAY TIMING CONTROLLERS USING DATA ENABLE SIGNAL

(75) Inventors: Jayawardan Janardhanan, Chennai (IN); Deepak Khanchandani, Bangalore (IN); Ramanujam Thodur Madabusi, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 302 days.

(21) Appl. No.: 10/176,663

(22) Filed: Jun. 24, 2002

(65) Prior Publication Data

US 2003/0234774 A1 Dec. 25, 2003

(51) Int. Cl.
*G09G 5/02* (2006.01)

(52) U.S. Cl. ..... 345/698; 345/690; 345/691; 345/558; 345/3.2

(58) Field of Classification Search ..... 345/3.1–3.4, 345/30, 50, 204, 205–215, 534, 558, 573, 345/10–14, 20, 22, 87, 589, 690–699; 340/441
See application file for complete search history.

(56) References Cited

U.S. PATENT DOCUMENTS

| | | | | | |
|---|---|---|---|---|---|
| 4,959,724 | A * | 9/1990 | Ueda | ..... | 348/320 |
| 5,125,028 | A * | 6/1992 | Naito | ..... | 380/223 |
| 5,144,418 | A * | 9/1992 | Brown et al. | ..... | 348/747 |
| 5,572,235 | A * | 11/1996 | Mical et al. | ..... | 345/600 |
| 5,757,338 | A * | 5/1998 | Bassetti et al. | ..... | 345/3.2 |
| 6,580,432 | B1 * | 6/2003 | Leung et al. | ..... | 345/558 |

* cited by examiner

*Primary Examiner*—Amr A. Awad
*Assistant Examiner*—Leonid Shapiro
(74) *Attorney, Agent, or Firm*—J. Dennis Moore; W. James Brady, III; Frederick J. Telecky, Jr.

(57) ABSTRACT

A digital display unit which receives horizontal lines of unequal length in a V-active region and computes an average length of the lines. The average is used to generate horizontal line demarkers in the V-blank (vertical blank) region. The demarkers specify the transition from one line to the other. Such a feature is useful in spread spectrum clocking (SSC) based display signals in which HSYNC signals may also not be available to determine the transitions from one line to another in the V-blank region.

13 Claims, 3 Drawing Sheets

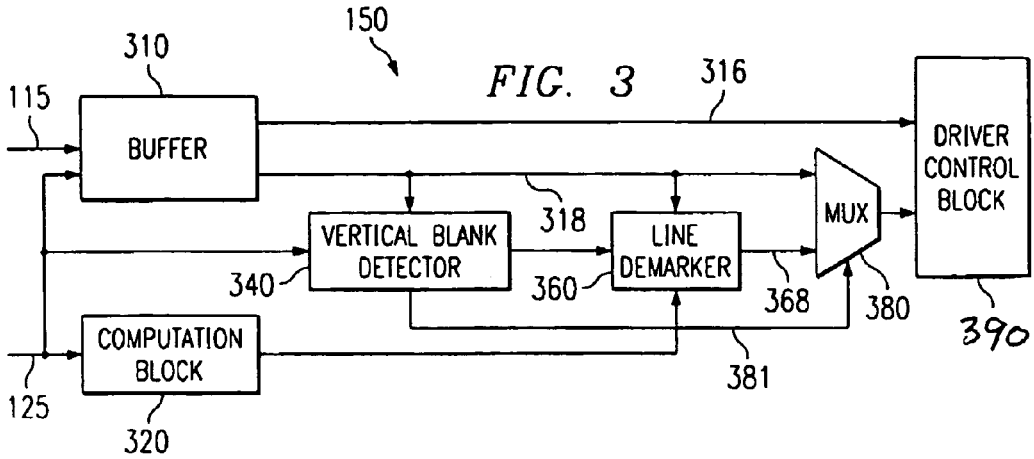
FIG. 3
FIG. 4A
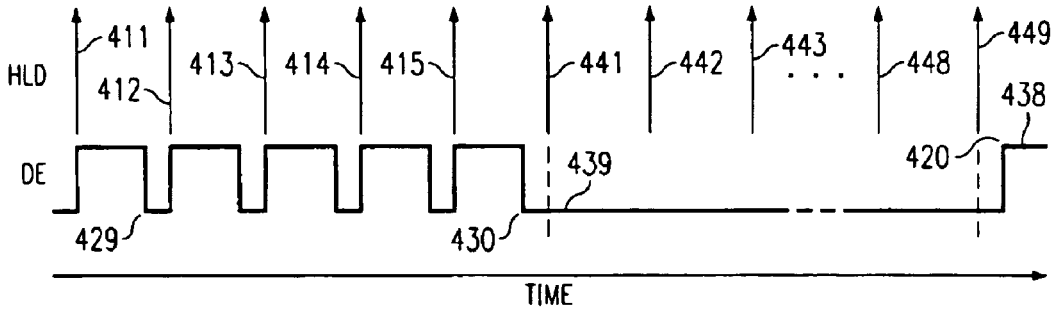
FIG. 4B
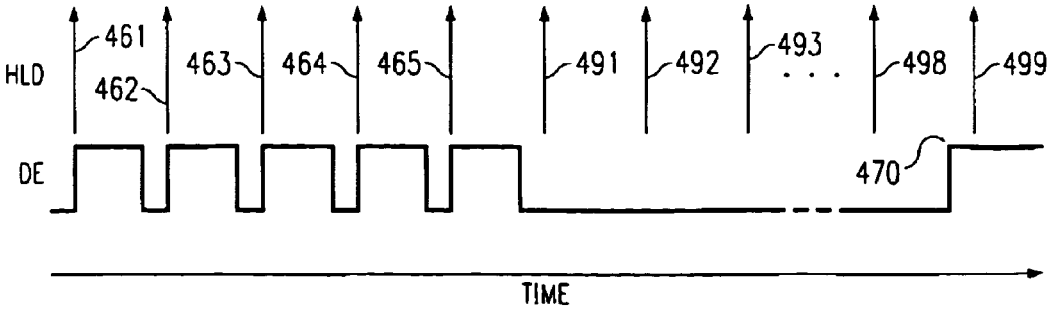

SUPPORTING VARIABLE LINE LENGTH IN DIGITAL DISPLAY TIMING CONTROLLERS USING DATA ENABLE SIGNAL

BACKGROUND OF THE INVENTION

1. Field of the Invention

The present invention relates to digital display units used in systems such as notebook computers, and more specifically to a method and apparatus for supporting spread spectrum clocking (SSC) in a digital display unit.

2. Related Art

Digital display units generally refer to devices containing a display panel which is formed of discrete points referred to as pixel elements. An image is generally displayed by appropriate activation to various degrees/colors, etc., of the individual pixel elements of a display panel as is well known in the relevant arts.

A digital display unit may be viewed as containing circuits ("controller circuit") which receive various input signals from an external source (e.g., a display controller contained in a host), and generate control and data signals to cause images (represented by input signals) to be displayed on a display panel. The control signals generally control various panel related circuits.

One such control signal is which indicates the transition from one line to the next, and may be referred to as horizontal demarcation line or horizontal line demarker. The horizontal line demarkers may be used to generate other control signals which drive the display panel. The horizontal line demarkers may need to be generated in vertical blanking period (VBL) as well. As is well known, VBL refers to the time duration between two successive image frames contained in the input signals.

A prior digital display unit may receive a HSYNC signal which indicates the transition between horizontal lines even during the VBL. As is well known, HSYNC signals are generally generated associated with analog display signals designed for CRT monitors. The transitions in HSYNC signals may be used to generate the horizontal line demarcation signals in digital display units as is well known in the relevant arts.

However, an external source generating input signals (for the digital display unit) may not generate HSYNC signals (for example, because support for CRT monitors is no longer required). Accordingly, a digital display unit may need to generate line demarker signals in the absence of HSYNC signals.

A prior digital display unit may receive a data enable (DE) signal associated with pixel values, and generate line demarker signals according to the DE signal. As is well known, a DE signal is generally at a high logical level in the active data region/duration (in which pixel values are being received), and at a low logical level otherwise. The transitions on DE may thus be used as the basis for generating the line demarker signals.

Unfortunately, a DE signal continues to be low potentially throughout the entire VBL, and information on transitions of lines may not be directly available from examination of the DE signal. Particular challenges may be presented in spread spectrum clocking (SSC) type scenarios in which the number of pixels is not constant in the horizontal lines.

Therefore, what is needed is a method and apparatus for providing horizontal line demarcation signals for digital display panels in VBL in the absence of HSYNC signal in SSC type scenarios.

SUMMARY

An embodiment of a digital display unit according to the present invention determines an expected length of horizontal lines based on the multiple horizontal lines received in a V-active (vertical active) region of a display signal, and generates horizontal line demarkers in the VBL (vertical blank) region according to the expected length. The expected length may equal the average of at least some of the horizontal lines received in the V-active region.

In one implementation, the display signal is generated according to spread spectrum clocking (in which lines are generated with unequal length), and only a display enable (DE) signal accompanies the pixel elements representing image frames. As a result, the horizontal line demarkers can be generated even when HSYNC type signals are not available.

A panel controller generating control and data signals to a display may contain a first-in-first-out (FIFO) buffer to store (and retrieve according FIFO) the DE samples and corresponding pixel elements. The rising edges of the DE signal are used to generate the horizontal line demarkers in the V-active region. Both the DE samples and the pixel elements may be provided to a panel controller after receiving from the FIFO output in the V-active region.

The buffer generally needs to be of sufficient size to tolerate a desired degree of error between the computed average and the accurate average according to which the VBL region may end. The buffer may conveniently be used for other purposes as well as described below.

An aspect of the present invention enables the start of new lines and VBL region to be determined accurately (without losing the pixel elements). The panel controller may make such determinations at successive time points determined by the computed average line length. If the length of the line (of an image frame) is less than (or equal to) the average, the rising edge of DE would be provided as a line demarker after being retrieved from the buffer.

If the length of the line is more than the average, the rising edge of the DE signal would be present in the buffer (assuming that the error in computation is within a limit determined by the length of the buffer), and the presence of the next active line may be determined based on an input being received into the buffer. On the other hand, if a low logical level is present at both the input and output of the buffer at such a time point determined by the computed average line length, the VBL region is determined to have started.

According to another aspect of the present invention, a panel controller operates without losing pixel elements even if the computed average is in slight error (within parameters determined by the FIFO buffer length). For example, if a last demarker in the VBL region (computed according to the average length) is ahead/earlier in time of a positive edge of the DE signal, such a situation is first determined by examining a DE sample being provided as an input to the FIFO buffer. Once the situation is detected, a horizontal line demarker is generated according to the positive edge of the DE signal instead of the last demarker.

On the other hand, if a positive edge of the DE signal is received ahead of a last computed demarker in the VBL region, the horizontal line demarker is generated according to the positive edge (i.e., ahead of the time point indicated by the last demarker) of the DE signal instead of the last demarker.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein:

FIG. 3 is a block diagram illustrating the details of implementation of a panel controller according to an aspect of the present invention; and FIGS. 4A and 4B are timing diagrams further illustrating the operation of an embodiment in accordance with the present invention.

DETAILED DESCRIPTION OF THE PREFERRED EMBODIMENTS

1. Overview and Discussion of the Invention

A panel controller according to an aspect of the present invention determines an expected length of each horizontal line based on the different lengths of lines received in non-VBL portion, and generates line demarcation signals according to the expected length in the vertical blanking period (VBL) region. In an embodiment, the expected length is determined by an average of the length (number of pixels) of multiple lines in the active region.

Accordingly, a panel controller may be implemented in situations such as when input signals (to digital display units) are received according to spread spectrum clocking (SSC), in which the length of horizontal lines is not constant in the vertical active region and other signals (such as HSYNC) are not available in the vertical blank region to facilitate easy determination of the horizontal line.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well-known structures or operations are not shown in detail to avoid obscuring the invention.

2. Example Environment

Figure 1A:
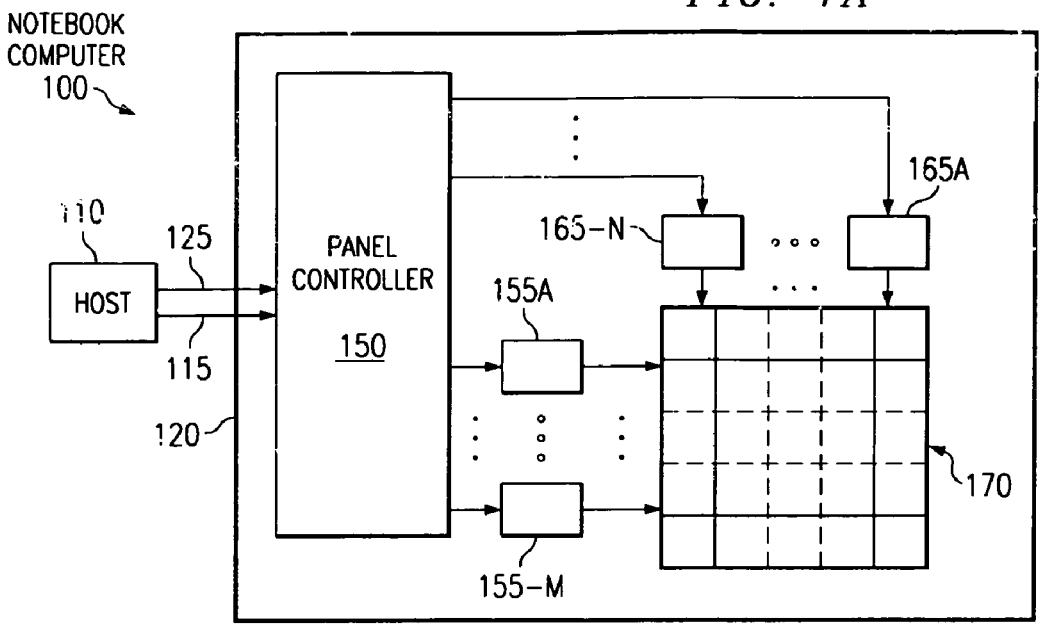
FIG. 1A is a block diagram illustrating an example environment in which the present invention can be implemented.

FIG. 1A is a block diagram of a note-book computer illustrating an example environment in which the present invention can be implemented. However, several aspects of the present invention can be implemented in other types of systems using digital display units. Notebook computer 100 is shown containing host 110, and digital display unit 120. Digital display unit 120 in turn is shown containing panel controller 150, gate drivers 155-A through 155-M, source drivers 165-A through 165-N, and display panel 170. Each block/component is described in further detail below.

Display panel 170 contains several pixel elements, which are activated to various degrees/time by gate drivers 155-A through 155-M and source drivers 165-A through 165-N. The activation causes images to be displayed. Display panel 170 may be implemented in a known way.

Gate (in general, column drivers) drivers 155-A through 155-M receive control signals from panel controller 150. The control signals may specify the specific rows in panel 170 to be enabled. Source (row) drivers 165-A through 165-N receive display data (e.g., in RGB format) from panel controller 150. Source drivers 165-A through 165-N and gate drivers 155-A through 155-M cause images to be displayed according to the received control signals and display data.

In an embodiment, some of the control signals received during the VBL region include a vertical strobe pulse and a vertical clock. As is well known in the relevant arts, the row drivers may be implemented as shift registers, shifting the strobe pulse, to activate the corresponding line. Hence the strobe pulse input to the row/gate drivers may need to be provided in the VBL region, sometimes before the first line is activated, or sometimes before the first line data is output by the gate drivers. The strobe pulses may be generated based on the horizontal line demarkers, and accordingly it may be necessary to generate the horizontal line demarkers in the VBL region as well. The two types of drivers may be implemented in a known way.

Host 110 sends a data enable (DE) signal and pixel values in digital format to panel controller 150. As is well known, a DE signal is generally at a high logical level in the active data region/duration (in which pixel values are being received), and at a low logical level otherwise.

Panel controller 150 receives DE signal and display data from host 110, and generates control and data signals to the gate and source drivers respectively to cause the images to be generated on panel 170. In general, the implementation of panel controller 150 needs to be consistent with the format of the input signals received from host 110. A panel controller according to an aspect of the present invention operates in conjunction with input signals in which the horizontal line length is not constant in the active display region. Display signals generated for spread spectrum clocking (SSC) is an example of such input signals. The format of the display signals in a SSC scenario are described below.

3. Display Signal Format in Spread Spectrum Clocking (SSC)

Figure 1B:
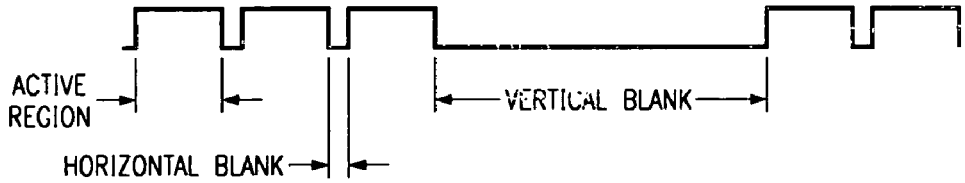
FIG. 1B is timing diagram of DE signal during the display of a frame.

FIG. 1B is timing diagram of DE signal during the display of a frame. DE signal has a high logical level when pixel values are transmitted on a parallel path, and in low logical level otherwise. Thus, DE signal is shown at low logical level in the horizontal blank (HBL) and vertical blank (VBL) periods.

Figure 1C:
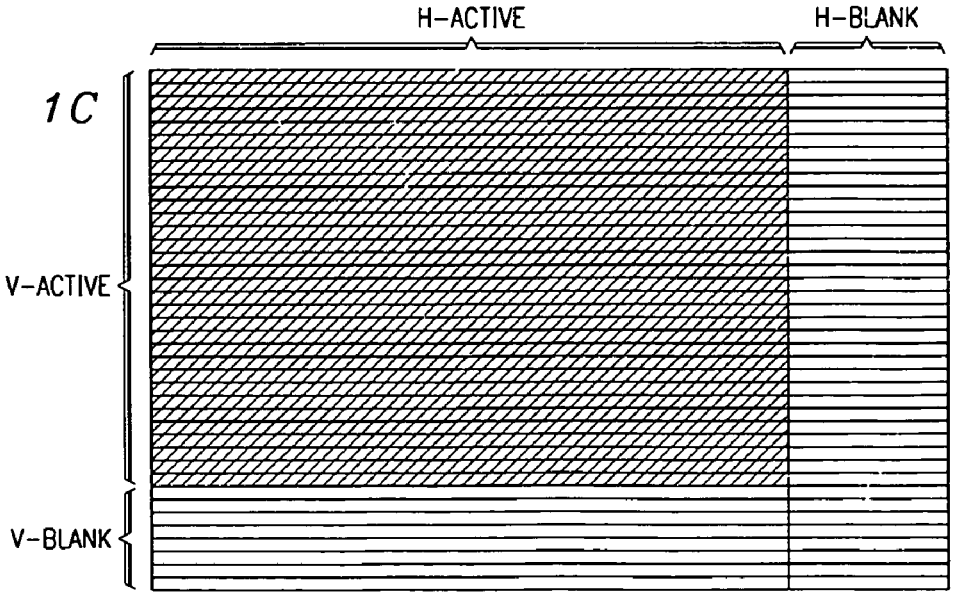
FIGS. 1C and 1D respectively represent the image frame formats with and without spread spectrum clocking (SSC)
Figure 1D:
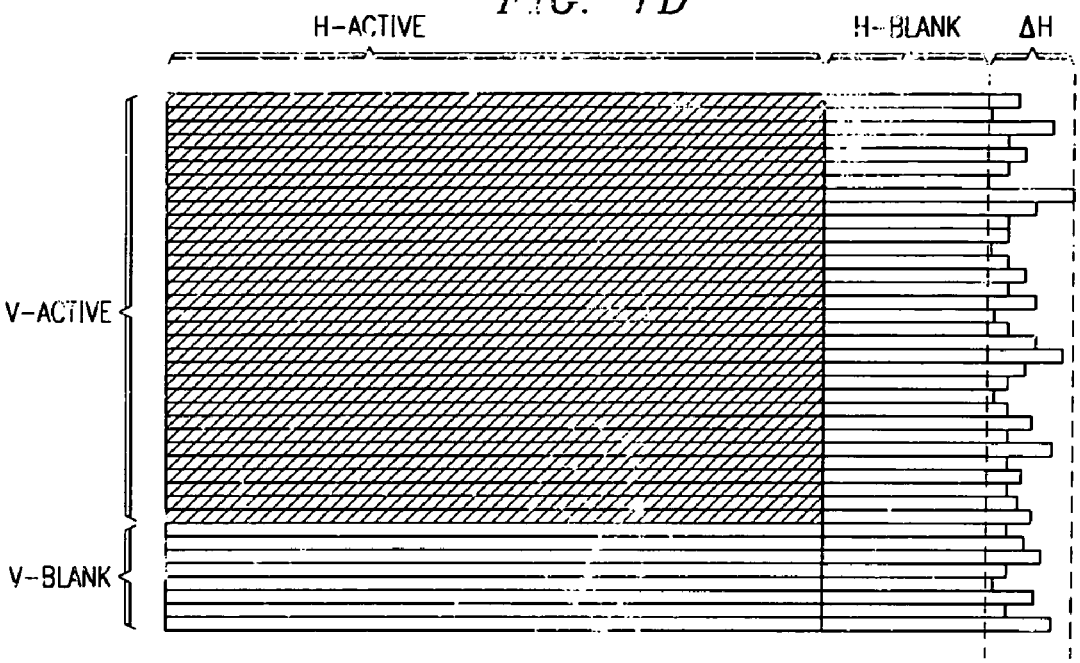

FIGS. 1C and 1D respectively represent the image frame formats with and without SSC. The number of lines and length of each line are merely illustrative of the format and may not correspond to practical implementations. As may be readily observed, the horizontal lines of FIG. 1C (without SSC) have a constant length throughout the V-active region. That is, both the H-active (pixel values received) and H-blank (corresponding to horizontal blank) components of a horizontal line are constant.

In contrast, in FIG. 1D, the length of the horizontal lines is not constant (due to SSC) in the V-active region as the length of the lines in the H-blank region is shown varying within a range of $\Delta H$. With the DE signal remaining low throughout the entire VBL (V-Blank) region, panel controller 150 may need to generate horizontal demarkers in the VBL region. The manner in which panel controller 150 may generate horizontal line demarkers which enable gate drivers 155-A through 155-M to drive display panel 170 is described below with examples.

4. Horizontal Line Demarcation Signal in VBL

Figure 2:
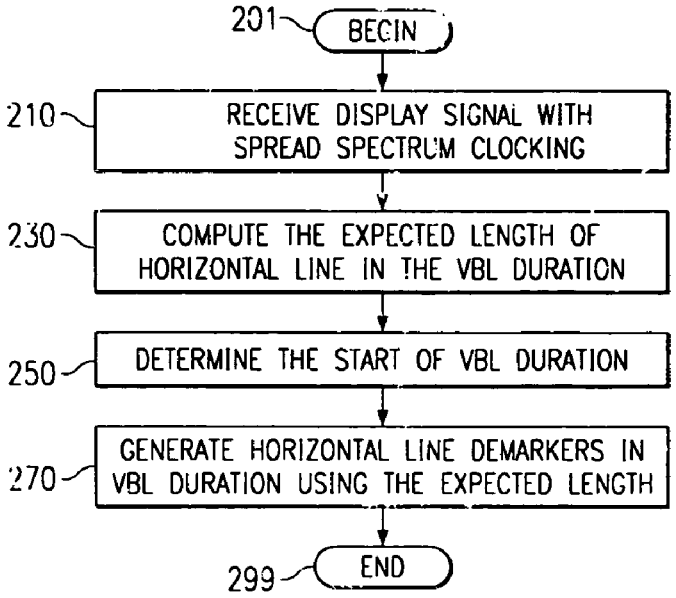
FIG. 2 is a flowchart illustrating a method according to an aspect of the present invention.

FIG. 2 is a flowchart illustrating a method using which a digital display unit may generate horizontal line demarkers in VBL. The flowchart is described with reference to panel controller 150 of FIG. 1 for illustration. The method can be implemented in other display units as well. The method begins in step 201, in which control immediately passes to step 210.

In step 210, panel controller 150 receives image frames with spread spectrum clocking (SSC) in which different lines have different lengths in the V-active region (as illustrated with reference to FIG. 1D). DE signal may indicate the specific time duration in which pixel values are being received. The pixel values may be received in formats such as RGB well known in the relevant arts. Pixel values and DE signal may be received via data path 115 and DE path 125 respectively.

In step 230, panel controller 150 determines an expected length of horizontal line based on the different lengths of lines received in an active display region. In an embodiment, the expected length is computed based on an average of multiple (e.g., 30) lines in the active region.

In step 250, panel controller 150 determines the start of VBL based on the DE signal. The determination is generally made using the fact that the VBL duration is much longer than the H-blank duration.

In step 270, panel controller 150 determines horizontal line demarcation time points based on the expected length determined in step 230. The horizontal line demarkers are generated in the VBL region based on the determined time points. In an embodiment described below, all the demarkers are generated at uniform intervals equaling the expected length.

Thus, a display controller according to the present invention generates horizontal line demarkers in the VBL region based on the non-uniform lengths of lines received in V-active region. However, implementations may need to take into consideration situations caused by errors in estimation, etc. An example embodiment which takes some of such considerations into account is described below in further detail.

5. Panel Controller

FIG. 3 is a block diagram illustrating the details of implementation of panel controller 150 in an embodiment of the present invention. Panel controller 150 is shown containing buffer 310, computation block 320, vertical blank detector 340, line demarker block 360, multiplexor 380 and driver control block 390. Only the details of panel controller 150 as necessary for an understanding of the described embodiments are included for conciseness.

Buffer 310 stores the DE samples (whether low or high) and associated pixel values. The size of buffer 310 is determined by the desired error tolerance to the estimation of the length of the horizontal line. Buffer 310 is implemented as a first-in-first-out (FIFO) storing pairs of DE sample and pixel value. For purpose of clarity, it will be described that a received input pair is placed in the first location and an output pair is retrieved from the last location (of the FIFO).

Computation block 320 computes an expected number of pixels in each line based on the lines received in the V-active region. In an embodiment, the expected number is set to equal an average number of pixels present in each horizontal line based on a few lines received during the V-active region. The number of pixels in each line may be measured by counting a number of clock cycles (e.g., rising edges of a clock signal) between two DE edges of same polarity (e.g., rising).

Accordingly, computation block 320 is shown receiving DE signal 307 to determine the start of each horizontal line. Computational block 320 may adjust the value of the expected number based on whether the DE signal is actually received ahead or later than the computed demarkers when processing successive image frames.

Line demarker block 360 generates the line demarker signals on line 368 for the VBL region. The start of V-blank (VBL) region may be indicated by vertical blank detector 340. The line demarker signals may be provided according to the average number computed by computation block 320.

Multiplexor 380 selects the DE signals received on path 318 during V-active region, and the signals (Acomputed demarker signals@) received on path 368 under the control of select signal 381. The selected signals are provided as horizontal line demarker to driver control block 360.

Driver control block 390 receives the pixel data elements on path 316 and horizontal line demarkers from multiplexor 380, and generates the necessary data and control signals to gate drivers 155-A through 155-M and source drivers 165-A through 165-N. Driver control block 390 may receive and generate other signals, which are not shown to avoid obscuring the details related to various aspects of the present invention.

Vertical blank detector 350 determines the start of the V-active and V-blank (VBL) durations, and controls select line 381 to cause multiplexor 380 to select the signals on line 368 during VBL region and the signals on line 316 during the V-active region. As a result, the rising edges of DE are selected as line demarkers in the V-active region and the demarkers generated by line demarker 360 are selected in the VBL region.

With respect to determination of start of VBL, the output of buffer 310 is examined at a time point determined by the computed average line length. Broadly, there are two possible scenarios as viewed from the perspective of the input at buffer 310: (1) VBL has started; or (2) VBL has not started. Scenario (1) may be determined based on DE signal being low at both line 125 and at the output of buffer 310 at the time point determined by the computed average line length.

With respect to scenario (2), there are two possible cases: (A) The actual length of the previously received line in the display image is less than or equal to the computed average line length; or (B) The actual length is more than the computed average. With respect to case (A), DE rising edge would already be received at the output of buffer 310, and thus would be passed through multiplexor 380 immediately upon retrieval from buffer 310.

In case (B), the rising edge of DE would be available in buffer 310 (assuming the error in computation of the average is within a limit allowed by the length of buffer 310). Vertical blank detector 350 may determine that VBL has started based on a low level on line 125 (input of the buffer). On the other hand, if a high level is detected at line 125, the next active line is determined to have started.

Once the V-blank duration is determined to have started, vertical blank detector 340 may indicate the same to line demarker block 360 to cause the line demarker signals to be generated according to the computed average. However, the line demarker signal close to the end of the vertical blank duration (or start of V-active) may be received ahead or after (in time) of the positive edge of the DE signal. The implementations may need to ensure that data is not lost in such boundary conditions as well. The manner in which such an objective is satisfied in an embodiment is described below with reference to the timing diagram of FIGS. 4A and 4B.

6. Timing Diagrams

FIGS. 4A and 4B are timing diagrams respectively illustrating the operation of various components of panel controller 150 in further detail (including in the boundary conditions when the V-Blank and V-active start). The diagrams illustrate that the embodiments described ensure that the pixel data is not lost when the computed average is less or more than a accurate average number, provided the error is within the limits determined by the length of buffer 310.

In FIG. 4A, horizontal line demarker signals are being shown generated at time points 411–415 in the V-active region based on the positive edge of the DE signal. The time between the negative edge (e.g., 429) and positive edge (412) represents the H-blank duration. During the V-active region, computational block 320 determines the average length ("computed average") of the horizontal lines.

V-blank is shown starting after time point 430. Assuming that the computed average indicates that a new line should start at time point 441, panel controller 150 determines that both the present sample (at time point 441) and a later sample (at time point 439) being received on line 125 are at a low value and thus determines that the VBL region has started.

As the start of V-blank is detected at time point 441, horizontal line demarkers may be continued to be generated as shown as time points 441, 442, 443, and 448 (with a time break between 443 and 448). While the demarkers 442 and 443 are shown at equal intervals from a prior demarker, it should be understood that the intervals can be unequal but averaged to approximately the computed average noted above.

However, it may be noticed that the next demarker 449 is computed to be slightly ahead of DE positive edge at time point 420. It may be undesirable to provide both the events as demarkers, and the manner in which such a situation may be dealt with is described below.

Just ahead of time point 449 (computed demarker), vertical blank detector 340 may examine the input to buffer 310 to determine that the DE signal being received into buffer 310 is already high. The sample at time point 438 (which is after time point 420) is examined as a result. Once DE high is detected, vertical blank detector 340 may indicate the start of V-active to line demarker block 360, which then causes DE to be selected by multiplexor 381. As a result, the horizontal line demarker may be provided to driver control block 36 a bit later than if computed demarker were provided as the demarker. Such minimal delays are generally acceptable, and thus the approach(es) of above may be deemed acceptable in situations when rising edge of DE arrives after a computed demarker.

FIG. 4B illustrates the details of operation when the rising edge of DE arrives before the computed line demarker. Line demarkers 461–465 are shown generated in the V-active region and VBL would be detected at time point 491 (similar to that above with reference to point 441). Demarkers 491–493 and 498 may be generated in the VBL region. However, the rising edge of DE (at point 470) is shown slightly ahead of the next line demarker 499. The arrival of the DE signal may be detected much ahead by examining line 125.

In such a situation, the rising edges of DE signal are directly caused to be provided as the demarker signals as the edges are received from buffer 310. In case of both the Figures the pixel values received from buffer 310 are provided to driver control block 360, which causes the images to be generated on display panel 170.

7. Conclusion

While various embodiments of the present invention have been described above, it should be understood that they have been presented by way of example only, and not limitation. Thus, the breadth and scope of the present invention should not be limited by any of the above described exemplary embodiments, but should be defined only in accordance with the following claims and their equivalents.

What is claimed is:

1. A method of generating a plurality of horizontal line demarkers in a vertical blank (VBL) region, said VBL region being present in a display signal received by a digital display unit, wherein said display signal contains a plurality of horizontal lines of unequal length in a vertical active (V-active) region, said method being performed in said digital display unit, wherein said display signal comprises a plurality of pixel elements accompanied by a DE signal, wherein said DE signal indicates whether said plurality of pixel elements are being received or not, wherein said determining comprises counting a number of clock cycles between two edges of said DE signal, said method comprising the steps of:

determining an expected length of horizontal lines based on said plurality of horizontal lines received in said V-active region, wherein said determining comprises computing an average length of at least some of said plurality of horizontal lines;

generating said plurality of horizontal line demarkers in said VBL region according to said expected length;

storing a plurality of samples of said DE signal and associated pixel elements in a first-in-first-out (FIFO) buffer, wherein said plurality of samples are stored in an input of said FIFO and retrieved from an output in a FIFO manner; and determining that said display signal is in said VBL region by examining a sample received from said output of said FIFO and at said input of said FIFO wherein a last demarker in said VBL region computed according to said average length is ahead of a positive edge of said DE signal, wherein said positive edge indicates entry into said V-active region, and said method further comprises:

examining said input to determine that said positive edge is received; and generating a last one of said plurality of horizontal line demarkers according to said positive edge instead of said last demarker.

2. The method of claim 1, wherein a positive edge of said DE signal is received ahead of a last demarker in said VBL region, wherein said positive edge indicates entry into said V-active region, said method further comprises:

generating a last one of said plurality of horizontal line demarkers according to said positive edge instead of said last demarker.

3. The method of claim 1, wherein said display signal contains a plurality of horizontal lines of unequal length due to spread spectrum clocking (SSC).

4. A panel controller for use in a digital display unit, said panel controller for generating a plurality of horizontal line demarkers in a vertical blank (VBL) region, said VBL region being present in a display signal received by said digital display unit, wherein said display signal contains a plurality of horizontal lines of unequal length in a vertical active (V-active) region, wherein said display signal comprises a plurality of pixel elements accompanied by a DE signal, wherein said DE signal indicates whether said plurality of pixel elements are being received or not, said panel controller comprising:

a computation block determining an expected length of horizontal lines based on said plurality of horizontal lines received in said V-active region, wherein said computation block determines said expected length to equal an average length of at least some of said plurality of horizontal lines by counting a number of clock cycles between two edges of said DE signal;

a line demarker block generating said plurality of horizontal line demarkers in said VBL region according to said expected length:

a FIFO buffer storing a plurality of samples of said DE signal and associated pixel elements, wherein said plurality of samples are stored in an input of said FIFO and retrieved from an output in a FIFO manner;

a vertical blank detector determining that said display signal is in said VBL region by examining a sample received from said output of said FIFO and a sample at said input of said FIFO; and a multiplexor selecting one of a DE sample received from the output of said FIFO buffer and a horizontal line demarker generated by said line demarker block, the selection of said multiplexor being controlled by said vertical blank detector, wherein a last demarker in said VBL region computed according to said average length is ahead of a positive edge of said DE signal, wherein said positive edge indicates entry into said V-active region, wherein said line demarker block examines said input to determine that said positive edge is received, and causes said multiplexor to select said positive edge instead of said last demarker as a line demarker.

5. A panel controller for use in a digital display unit, said panel controller for generating a plurality of horizontal line demarkers in a vertical blank (VBL) region, said VBL region being present in a display signal received by said digital display unit, wherein said display signal contains a plurality of horizontal lines of unequal length in a vertical active (V-active) region, wherein said display signal comprises a plurality of pixel elements accompanied by a DE signal, wherein said DE signal indicates whether said plurality of pixel elements are being received or not, said panel controller comprising:

a computation block determining an expected length of horizontal lines based on said plurality of horizontal lines received in said V-active region, wherein said computation block determines said expected length to equal an average length of at least some of said plurality of horizontal lines by counting a number of clock cycles between two edges of said DE signal;

a line demarker block generating said plurality of horizontal line demarkers in said VBL region according to said expected length:

a FIFO buffer storing a plurality of samples of said DE signal and associated pixel elements, wherein said plurality of samples are stored in an input of said FIFO and retrieved from an output in a FIFO manner;

a vertical blank detector determining that said display signal is in said VBL region by examining a sample received from said output of said FIFO and a sample at said input of said FIFO; and a multiplexor selecting one of a DE sample received from the output of said FIFO buffer and a horizontal line demarker generated by said line demarker block, the selection of said multiplexor being controlled by said vertical blank detector, wherein a positive edge of said DE signal is received ahead of a last demarker in said VBL region, wherein said positive edge indicates entry into said V-active region, wherein said line demarker block generates a last one of said plurality of horizontal line demarkers according to said positive edge instead of said last demarker.

6. A panel controller for use in a digital display unit, said panel controller for generating a plurality of horizontal line demarkers in a vertical blank (VBL) region, said VBL region being present in a display signal received by said digital display unit, wherein said display signal contains a plurality of horizontal lines of unequal length in a vertical active (V-active) region, wherein said display signal comprises a plurality of pixel elements accompanied by a DE signal, wherein said DE signal indicates whether said plurality of pixel elements are being received or not, said panel controller comprising:

a computation block determining an expected length of horizontal lines based on said plurality of horizontal lines received in said V-active region, wherein said computation block determines said expected length to equal an average length of at least some of said plurality of horizontal lines by counting a number of clock cycles between two edges of said DE signal;

a line demarker block generating said plurality of horizontal line demarkers in said VBL region according to said expected length:

a FIFO buffer storing a plurality of samples of said DE signal and associated pixel elements, wherein said plurality of samples are stored in an input of said FIFO and retrieved from an output in a FIFO manner; and a vertical blank detector determining that said display signal is in said VBL region by examining a sample received from said output of said FIFO and a sample at said input of said FIFO, wherein said vertical blank detector determines whether said display signal is in said VBL region at time points determined by said average length, wherein the length of an active line in said V-active region is more than said average length, wherein said FIFO buffer stores a rising edge of said DE signal following said active line, and wherein said vertical blank detector causes said rising edge in said FIFO buffer to be provided as one of said plurality of horizontal line demarker signals.

7. A panel controller for use in a digital display unit, said panel controller for generating a plurality of horizontal line demarkers in a vertical blank (VBL) region, said VBL region being present in a display signal received by said digital display unit, wherein said display signal contains a plurality of horizontal lines of unequal length in a vertical active (V-active) region, wherein said display signal comprises a plurality of pixel elements accompanied by a DE signal, wherein said DE signal indicates whether said plurality of pixel elements are being received or not, said panel controller comprising:

a computation block determining an expected length of horizontal lines based on said plurality of horizontal lines received in said V-active region, wherein said computation block determines said expected length to equal an average length of at least some of said plurality of horizontal lines by counting a number of clock cycles between two edges of said DE signal;

a line demarker block generating said plurality of horizontal line demarkers in said VBL region according to said expected length:

a FIFO buffer storing a plurality of samples of said DE signal and associated pixel elements, wherein said plurality of samples are stored in an input of said FIFO and retrieved from an output in a FIFO manner; and a vertical blank detector determining that said display signal is in said VBL region by examining a sample received from said output of said FIFO and a sample at said input of said FIFO, wherein said vertical blank detector determines whether said display signal is in said VBL region at time points determined by said average length, wherein the length of an active line in said V-active region is less than said average length, wherein said FIFO buffer stores a rising edge of said DE signal following said active line, and wherein said vertical blank detector causes said rising edge in said FIFO buffer to be provided as one of said plurality of horizontal line demarker signals ahead of a time point determined by said average length.

8. A digital display unit comprising:

a display panel; and a panel controller controlling the display on said display panel, said display panel generating a plurality of horizontal line demarkers in a vertical blank (VBL) region, said VBL region being present in a display signal received by said digital display unit, wherein said display signal contains a plurality of horizontal lines of unequal length in a vertical active (V-active) region, wherein said display signal comprises a plurality of pixel elements accompanied by a DE signal, wherein said DE signal indicates whether said plurality of pixel elements are being received or not, said panel controller comprising:

a computation block determining an expected length of horizontal lines based on said plurality of horizontal lines received in said V-active region, said expected length equaling an average length of at least some of said plurality of horizontal lines, wherein said determining comprises counting a number of clock cycles between two edges of said DE signal, and a line demarker block generating said plurality of horizontal line demarkers in said VBL region according to said expected length;

a FIFO buffer storing a plurality of samples of said DE signal and associated pixel elements, wherein said plurality of samples are stored in an input of said FIFO and retrieved from an output in a FIFO manner;

a vertical blank detector determining that said display signal is in said VBL region by examining a sample received from said output of said FIFO and a sample at said input of said FIFO; and a multiplexor selecting one of a DE sample received from the output of said FIFO buffer and a horizontal line demarker generated by said line demarker block, the selection of said multiplexor being controlled by said vertical blank detector, wherein a last demarker in said VBL region computed according to said average length is ahead of a positive edge of said DE signal, wherein said positive edge indicates entry into said V-active region, wherein said line demarker block examines said input to determine that said positive edge is received, and causes said multiplexor to select said positive edge instead of said last demarker as a line demarker.

9. A digital display unit comprising:

a display panel; and a panel controller controlling the display on said display panel, said display panel generating a plurality of horizontal line demarkers in a vertical blank (VBL) region, said VBL region being present in a display signal received by said digital display unit, wherein said display signal contains a plurality of horizontal lines of unequal length in a vertical active (V-active) region, wherein said display signal comprises a plurality of pixel elements accompanied by a DE signal, wherein said DE signal indicates whether said plurality of pixel elements are being received or not, said panel controller comprising:

a computation block determining an expected length of horizontal lines based on said plurality of horizontal lines received in said V-active region, said expected length equaling an average length of at least some of said plurality of horizontal lines, wherein said determining comprises counting a number of clock cycles between two edges of said DE signal, and a line demarker block generating said plurality of horizontal line demarkers in said VBL region according to said expected length;

a FIFO buffer storing a plurality of samples of said DE signal and associated pixel elements, wherein said plurality of samples are stored in an input of said FIFO and retrieved from an output in a FIFO manner;

a vertical blank detector determining that said display signal is in said VBL region by examining a sample received from said output of said FIFO and a sample at said input of said FIFO; and a multiplexor selecting one of a DE sample received from the output of said FIFO buffer and a horizontal line demarker generated by said line demarker block, the selection of said multiplexor being controlled by said vertical blank detector, wherein a positive edge of said DE signal is received ahead of a last demarker in said VBL region, wherein said positive edge indicates entry into said V-active region, wherein said line demarker block generates a last one of said plurality of horizontal line demarkers according to said positive edge instead of said last demarker.

10. The digital display unit of claim 8, wherein said display signal contains a plurality of horizontal lines of unequal length due to spread spectrum clocking (SSC).

11. A computer system comprising:

a host generating a display signal contains a plurality of horizontal lines of unequal length in a vertical active (V-active) region, said display signal further containing a vertical blank (VBL) region, and wherein said display signal comprises a plurality of pixel elements accompanied by a DE signal, wherein said DE signal indicates whether said plurality of pixel elements are being received or not;

a display panel;

a panel controller receiving said display signal and controlling the display on said display panel, said panel controller generating a plurality of horizontal line demarkers in said VBL region, said panel controller comprising:

means for determining an expected length of horizontal lines based on said plurality of horizontal lines received in said V-active region by setting said expected length to equal an average length of at least some of said plurality of horizontal lines, wherein said means for determining counts a number of clock cycles between two edges of said DE signal, and means for generating said plurality of horizontal line demarkers in said VBL region according to said expected length;

means for storing a plurality of samples of said DE signal and associated pixel elements in a first-in-first-out (FIFO) buffer, wherein said plurality of samples are stored in an input of said FIFO and retrieved from an output in a FIFO manner; and means for determining that said display signal is in said VBL region by examining a sample received from said output of said FIFO and a sample at said input of said FIFO, wherein a last demarker in said VBL region computed according to said average length is ahead of a positive edge of said DE signal, wherein said positive edge indicates entry into said V-active region, said computer system further comprises:

means for examining said input to determine that said positive edge is received; and means for generating a last one of said plurality of horizontal line demarkers according to said positive edge instead of said last demarker.

12. The computer system of claim 11, wherein a positive edge of said DE signal is received ahead of a last demarker in said VBL region, wherein said positive edge indicates entry into said V-active region, said computer system further comprises:

means for generating a last one of said plurality of horizontal line demarkers according to said positive edge instead of said last demarker.

13. The computer system of claim 11, wherein said display signal contains a plurality of horizontal lines of unequal length due to spread spectrum clocking (SSC).

* * * * *